United States Patent [19]

Laviolette

[11] 4,164,904

[45] Aug. 21, 1979

[54] TUBULAR PROJECTILE

[75] Inventor: Maurice A. Laviolette, Quebec, Canada

[73] Assignee: Her Majesty the Queen in right of Canada, as represented by the Minister of National Defence, Ottawa, Canada

[21] Appl. No.: 936,391

[22] Filed: Aug. 24, 1978

Related U.S. Application Data

[63] Continuation of Ser. No. 746,820, Dec. 1, 1976, abandoned, which is a continuation-in-part of Ser. No. 660,120, Feb. 23, 1976, abandoned, which is a continuation of Ser. No. 521,138, Nov. 5, 1974, abandoned.

[30] Foreign Application Priority Data

Nov. 16, 1973 [CA] Canada ..... 185955
Aug. 30, 1974 [CA] Canada ..... 208146

[51] Int. Cl.[2] ..... F42B 13/20
[52] U.S. Cl. ..... 102/92.7; 102/93; 102/DIG. 10
[58] Field of Search ..... 102/92.1–92.7, 102/DIG. 10; 244/3.1

[56] References Cited

U.S. PATENT DOCUMENTS

| | | | |
|---|---|---|---|
| 1,103,740 | 7/1914 | Cooper | 102/DIG. 10 |
| 2,386,054 | 10/1945 | McGee | 102/DIG. 10 |
| 2,433,334 | 12/1947 | Birkeland | 102/DIG. 10 |
| 3,024,729 | 3/1962 | Kluge | 102/DIG. 10 |

FOREIGN PATENT DOCUMENTS

| | | | |
|---|---|---|---|
| 308434 | 2/1920 | Fed. Rep. of Germany | 102/DIG. 10 |

OTHER PUBLICATIONS

S. Rethorst et al., High Performance Hollow Projectiles, VRC Report No. 26, Tech. Report SASA Cont. No. DAAD05-72-C-0296, Aug., 1973.

*Primary Examiner*—Verlin R. Pendegrass
*Attorney, Agent, or Firm*—Cushman, Darby & Cushman

[57] ABSTRACT

A projectile adapted to be fired at supersonic velocity from a gun barrel includes a tubular body of substantially circular cross-section having a leading inlet end and a trailing exit end and a central passageway extending therethrough. The leading end of the body is of a shape such that the internal diameter of the central passageway decreases from the leading inlet end to a throat region. The ratio of the cross-sectional area of the passageway in the throat region ($A_t$) to the cross-sectional area of the passageway at the leading inlet end ($A_i$) is sufficiently large and is so related to the projectile velocity at launch as to enable a normal shock wave to pass through the throat region to establish supersonic flow in the passageway and thus provide a relatively low aerodynamic drag after launching. The ratio $A_t/A_i$ also has a value less than 1.0 so that as the velocity of the projectile decreases to a predetermined flight Mach number, which is a function of the $A_t/A_i$ ratio, the shock wave is expelled from the passageway to establish choked flow conditions in said passageway and relatively high aerodynamic drag whereby to limit the range of the projectile.

5 Claims, 21 Drawing Figures

SKETCHES OF THE STUP CONFIGURATIONS

TUBULAR PROJECTILE

This is a continuation of application Ser. No. 746,820, filed Dec. 1, 1976, now abandoned, which is a continuation-in-part of application Ser. No. 660,120, filed Feb. 23, 1976, now abandoned, which is a continuation of application Ser. No. 521,138, Nov. 5, 1974, now abandoned.

This invention relates to an improved tubular projectile.

Projectiles are commonly launched at supersonic velocities from a gun, a launcher rack, or the like. They are intended to follow a desired trajectory from a launch site or vehicle to a target or target area. The trajectory wanted is often difficult to achieve. This may be due to stringent trajectory requirements such as one with low velocity decay to the target followed by a high velocity decay and instability beyond the target to reduce the range. In another situation there may be a need to maximize the range. It may also be due to extraneous and disruptive forces generated either during launching, or in free flight.

A basic object of the present invention is to provide an improved low cost tubular projectile particularly suitable for training purposes. Another object is to provide a tubular projectile having a configuration and internal profile which is tailored to satisfy predetermined trajectory requirements. A more specific objective is to provide for a controlled variation in the drag forces applicable to the tubular projectile in supersonic free flight, to cause that projectile to follow a preselected flight pattern.

The importance of tailoring the trajectory of a projectile to meet specified requirements is especially notable in, although not limited to, the case of projectiles designed as practice rounds. It is desirable that there be a rapid velocity decay after the projectile has travelled the maximum useful distance thereby to reduce the size of the danger zone. If the tubular projectile is to have value as a training device it must be possible to match its ballistic trajectory fairly closely to that of the actual weapon which it is designed to simulate e.g. an armour piercing discarding sabot (otherwise known by the acronym APDS). The break-up pattern upon impact, the range of the projectile following richochet and the cost of the projectile are also factors to be considered.

The present invention, in part, involves the discovery that, in order for a tubular projectile to perform satisfactorily, the projectile must be arranged such that supersonic flow conditions are established within the central passageway of the projectile immediately after launch thereby to achieve low drag conditions over the first portion of the flight path. The invention further provides for the projectile configuration to be arranged such that as the velocity decays down to a certain flight Mach number, choked flow conditions are suddenly established within the central passageway. This choked flow condition sets up a normal shock wave ahead of the projectile causing relatively rapid velocity decay thus limiting the range of the projectile.

Although the prior art has provided a plurality of types of tubular projectiles, none of the known prior art designs are capable of providing the range limiting transition from low drag conditions to high drag in accordance with the invention. In fact, it can be shown that virtually all of the prior art tubular designs have choked subsonic flow in the central passageway at start up, and consequent high drag through the entire flight path. This condition is totally unacceptable especially for high kinetic energy rounds which require high velocities at the target.

In one aspect the invention provides a projectile adapted to be fired at supersonic velocity from a gun barrel and comprising: a tubular body of substantially circular cross-section having a leading inlet end and a trailing exit end and a central passageway extending therethrough; the leading end of the body being of a shape such that the internal diameter of the central passageway decreases from the leading inlet end to a throat region, the ratio of the cross-sectional area of said passageway in the throat region ($A_t$) to the cross-sectional area of said passageway at the leading inlet end ($A_i$) being sufficiently large and being so related to the projectile velocity at launch as to enable a normal shock wave to pass through the throat region to establish supersonic flow in said passageway and thus provide a relatively low aerodynamic drag after launching, with said ratio $A_t/A_i$ also being a value less than 1.0 so that as the velocity of the projectile decreases to a predetermined flight Mach number, the shock wave is expelled from the passageway to establish choked flow conditions in said passageway and relatively high aerodynamic drag whereby to limit the range of the projectile.

In a further aspect the invention provides a projectile adapted to be fired at a supersonic velocity from a gun barrel and comprising: a tubular body of substantially circular cross-section having a leading inlet end and a trailing exit end and a central passageway extending therethrough; the leading end of the body being in the form of an annular wedge with the internal diameter of the central passageway decreasing from the leading inlet end to a throat region, the ratio of the cross-sectional area of said passageway in the throat region ($A_t$) to the cross-sectional area of said passageway at the leading inlet end ($A_i$) being sufficiently greater than that defined by the equation:

$$\left(\frac{A_t}{A_i}\right)_{min} = \frac{\left(1+\frac{\gamma-1}{2}M^2\right)^{1/2}\left(\gamma M^2-\frac{\gamma-1}{2}\right)^{1/\gamma-1}}{\left(\frac{\gamma+1}{2}M^2\right)^{\gamma+1/2(\gamma-1)}}$$

where

M = Mach number at launch (for M > 1.0)

$\gamma$ = Ratio of specific heats as to enable a normal shock wave to pass through the throat region to establish supersonic flow in said passageway and thus provide a relatively low aerodynamic drag after launching, with said ratio $A_t/A_i$ also being a value less than 1.0 so that as the velocity of the projectile decreases to a predetermined flight Mach number, the shock wave is expelled from the passageway to establish choked flow conditions in said passageway and relatively high aerodynamic drag whereby to limit the range of the projectile.

Once the $A_t/A_i$ ratio has been selected such as to ensure supersonic flow in the central passageway of the projectile at the designated launch velocity, it is possible to predict the velocity (or Mach number) at which choked flow conditions are established in the passageway as the velocity of the projectile decays during flight. The equation which relates the theoretical "choking" flight Mach number to the selected $A_t/A_i$ ratio is as follows:

$$\frac{A_t}{A_i} = \frac{M}{\left(\frac{1+\frac{\gamma-1}{2}M^2}{\frac{\gamma+1}{2}}\right)^{\gamma+1/2(\gamma-1)}}$$

(M=flight Mach number
$\gamma$=ratio of specific heats)

In a further feature the wall thickness ratio of the projectile t/R is from 0.15 to 0.45 where:

t=maximum wall thickness,

R=maximum radial distance from projectile axis to outside surface of projectile.

In a still further feature the annular wedge at the leading end of the body is an internal wedge defining a generally sharp leading edge arranged to enable an oblique shock wave to attach itself to the leading edge after launching to assist in providing low aerodynamic drag on the projectile.

In a preferred form of the invention the annular wedge at the leading end of the body is a composite wedge defining a generally sharp leading edge of the projectile with the included angle of such composite wedge being sufficiently small as to enable an oblique shock wave to attach itself to said leading edge after launching to assist in providing low aerodynamic drag on the projectile.

The projectile may also include a pusher base and a gas seal arrangement mounted to the trailing end of the tubular body to transfer gaseous pressures in the gun barrel to a driving force on said body and being separable from the latter by virtue of stagnation pressures acting on the pusher base after launch.

The projectile may also include a driver band mounted to an outside surface of the tubular body and adapted to engage with rifling grooves in a gun barrel to impart spin to the projectile.

In accordance with a further feature said pusher base includes a leading end of ogive configuration which, prior to separation, is enclosed within said tubular body.

Further features of the invention are set forth in the following disclosure and in the claims appended hereto.

In drawings which illustrate embodiments of the invention:

Figure 1:
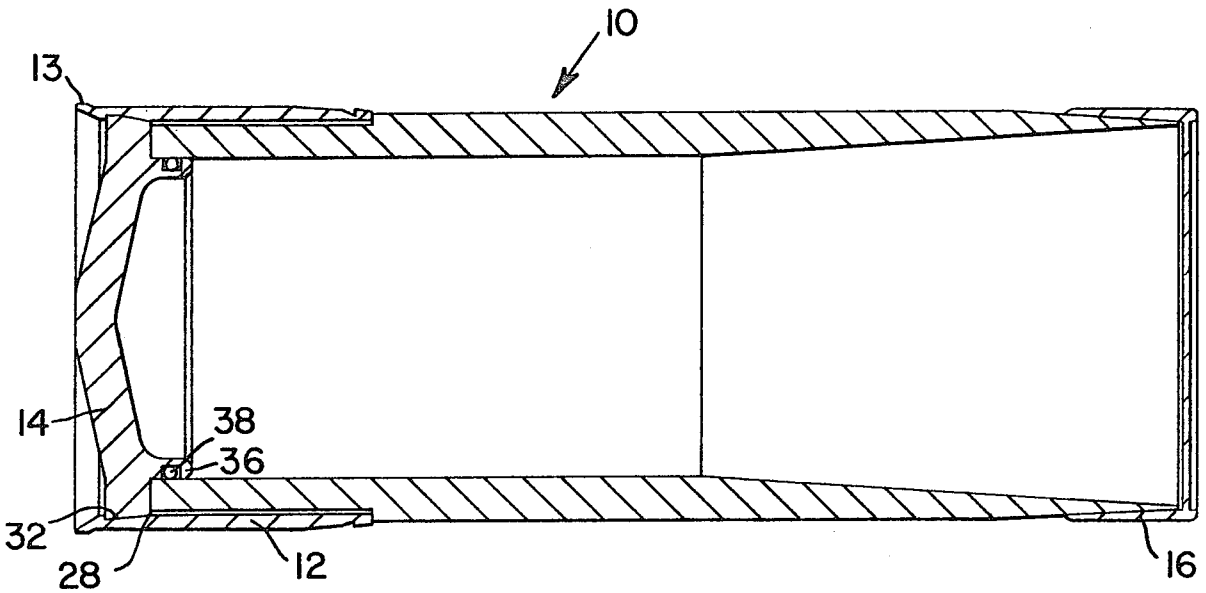
FIG. 1 is a longitudinal section view of a tubular projectile assembly taken along the axis of the projectile.
Figure 3:
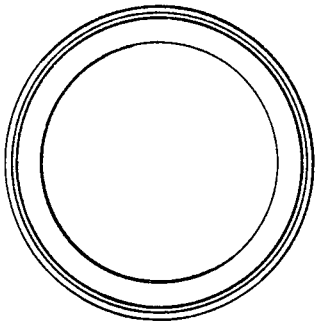
FIG. 3 is an elevation view of the trailing end of the projectile.
Figure 2:
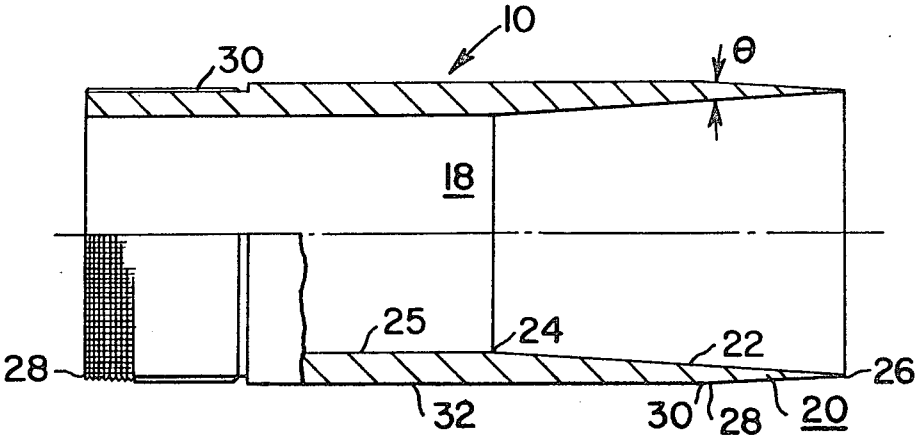
FIG. 2 is a view similar to FIG. 1 showing the flight configuration of the projectile.
Figure 10:
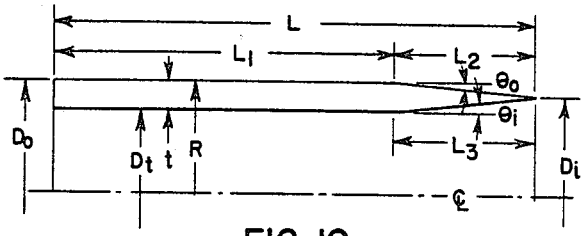
Figure 7:
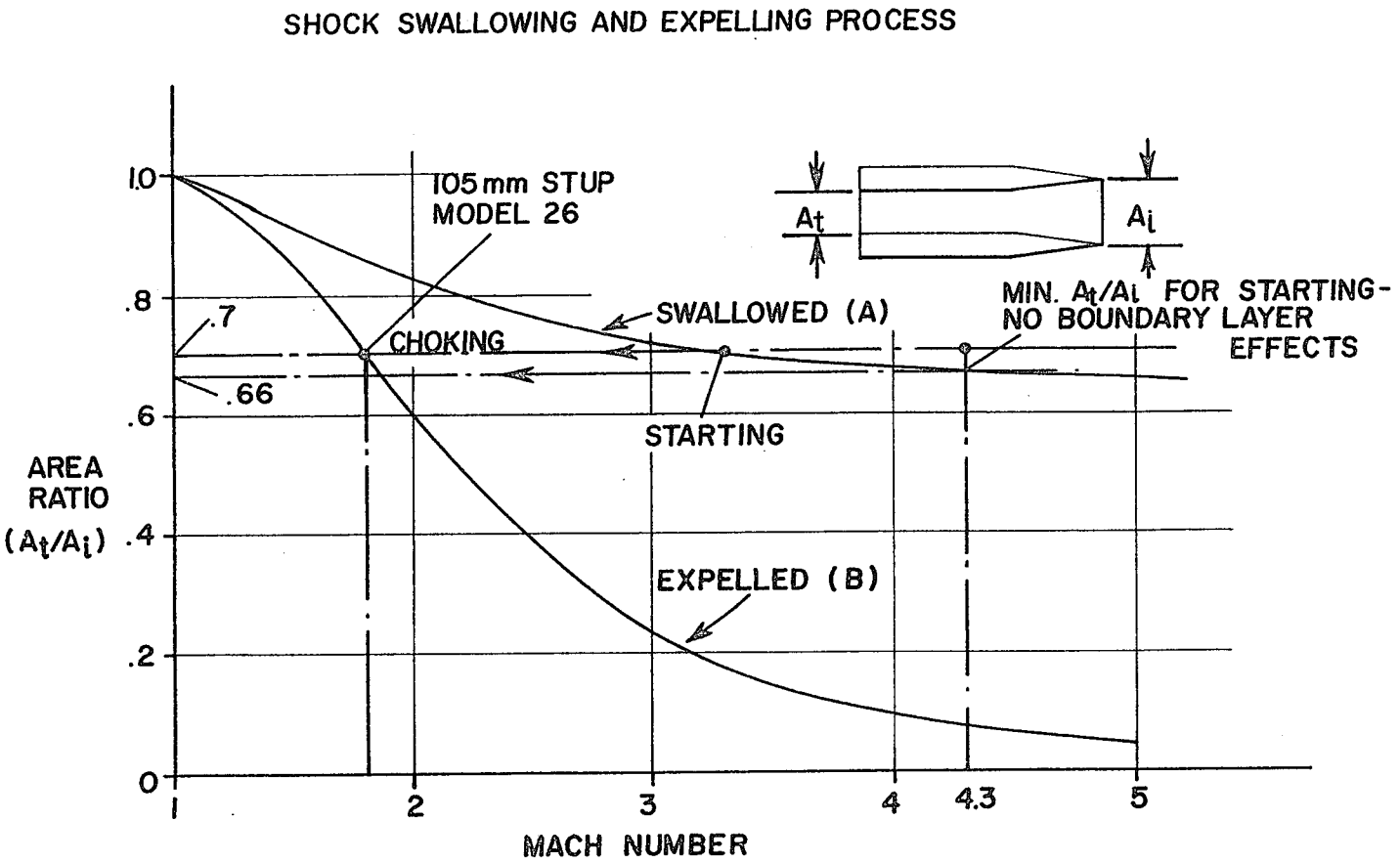
Figure 8:
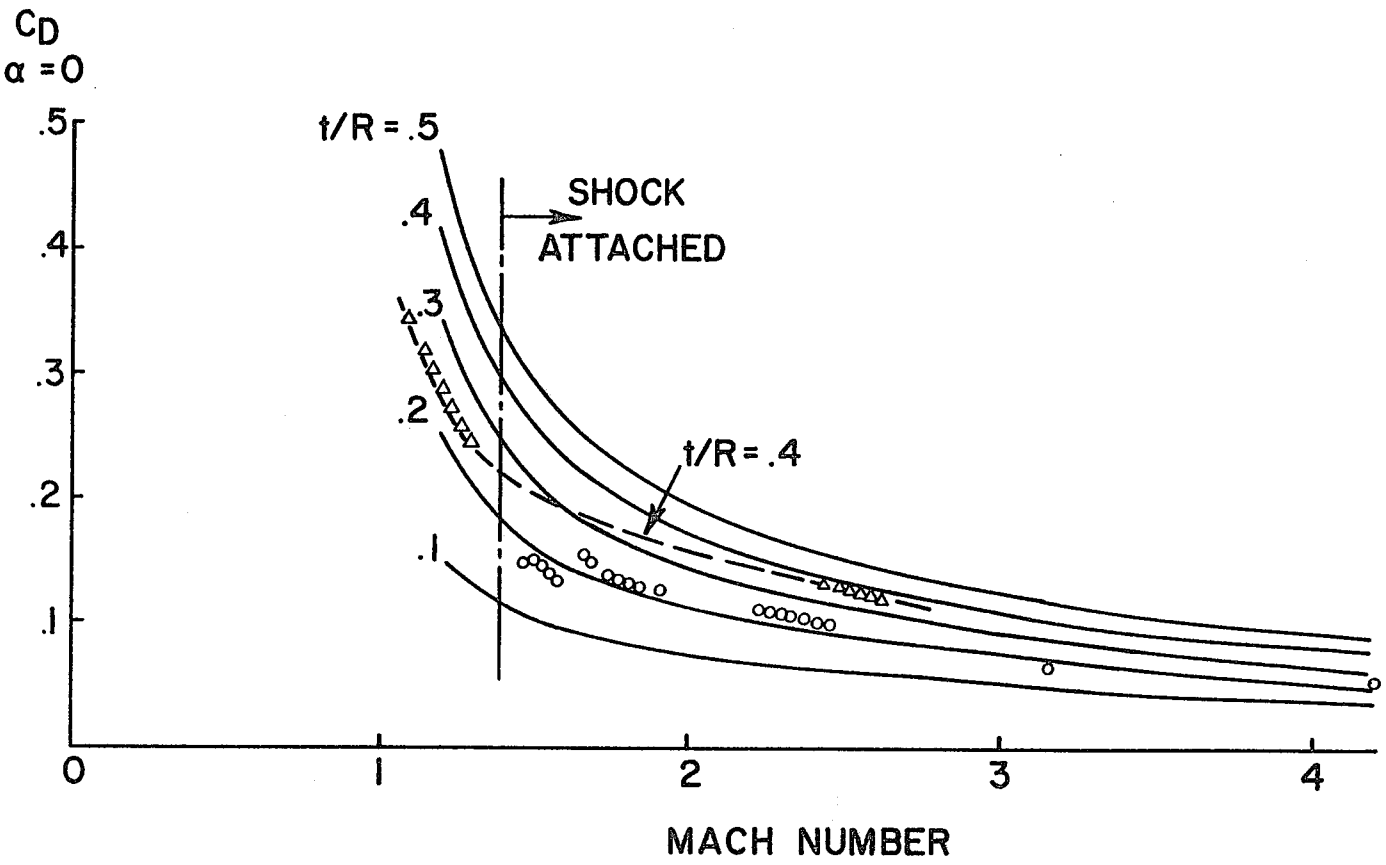
Figure 9:
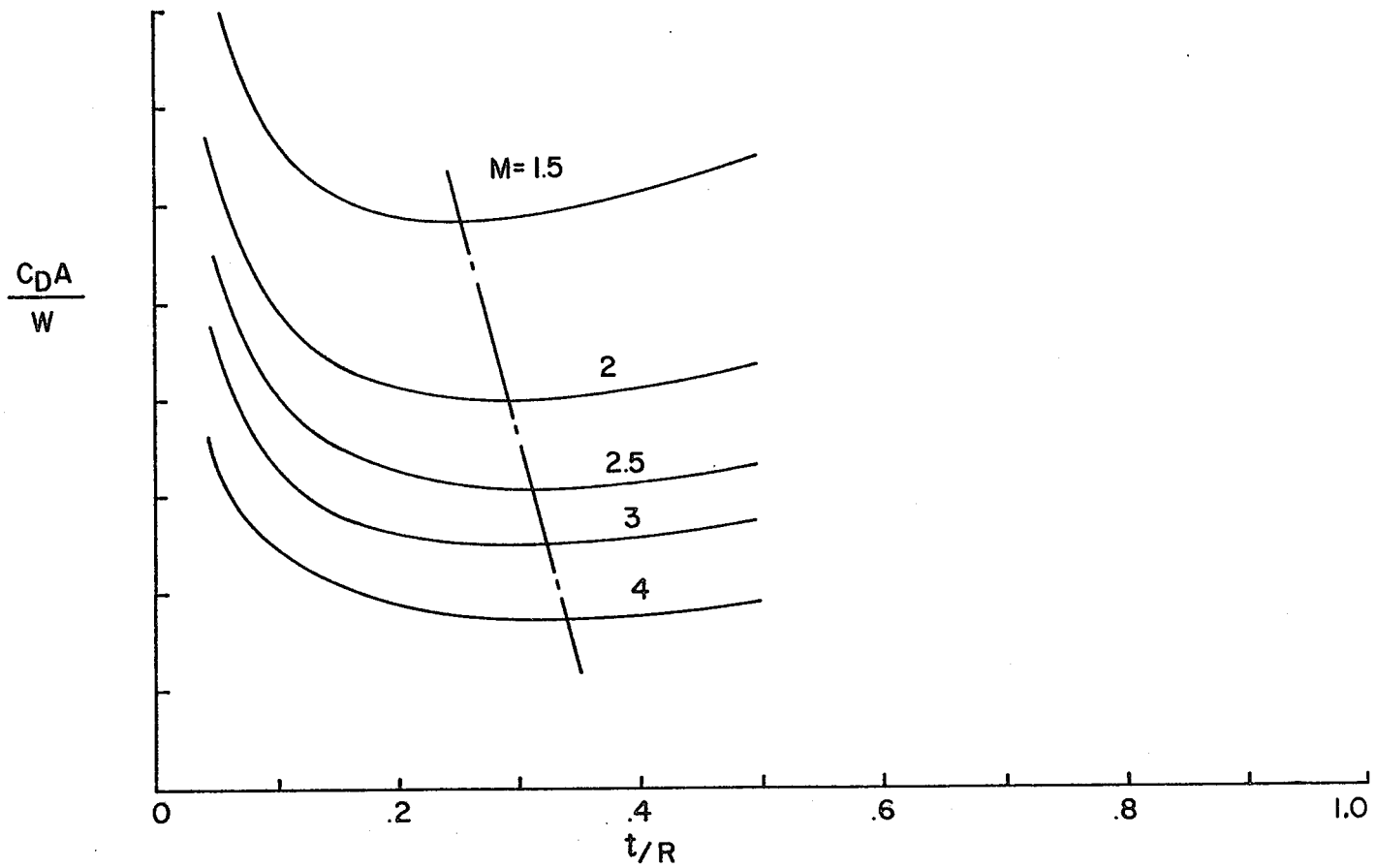
Figure 11:
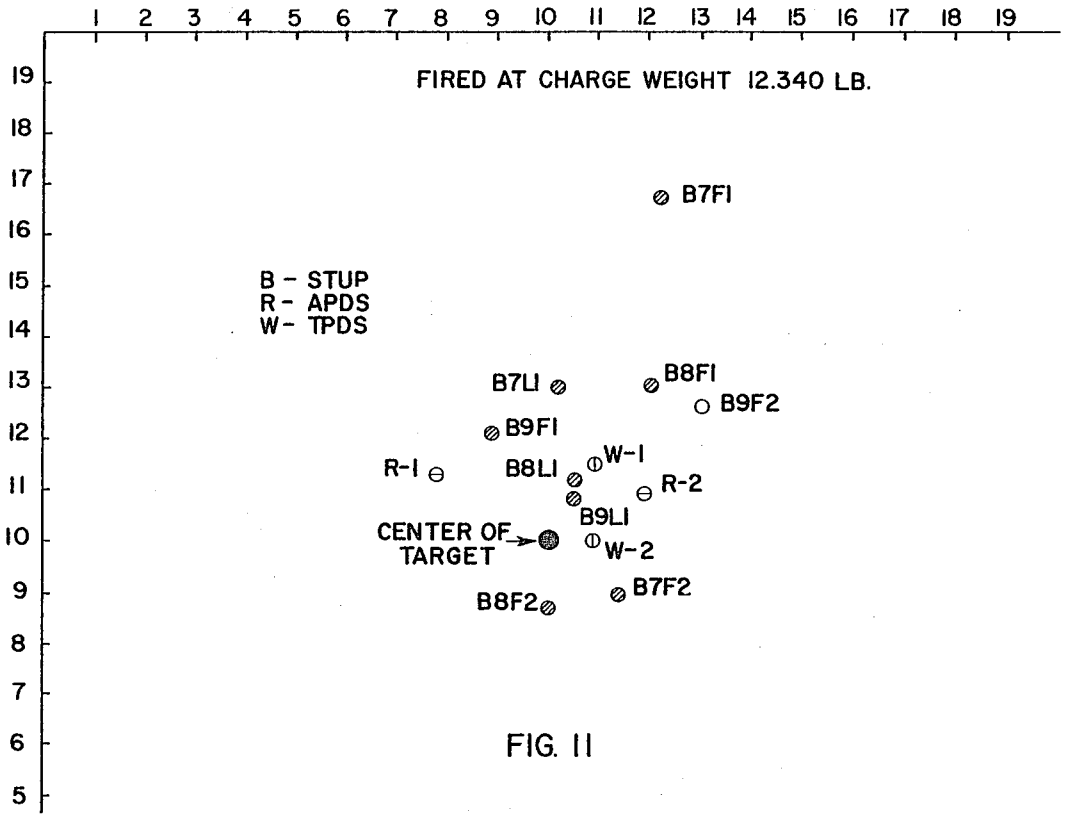
Figure 12:
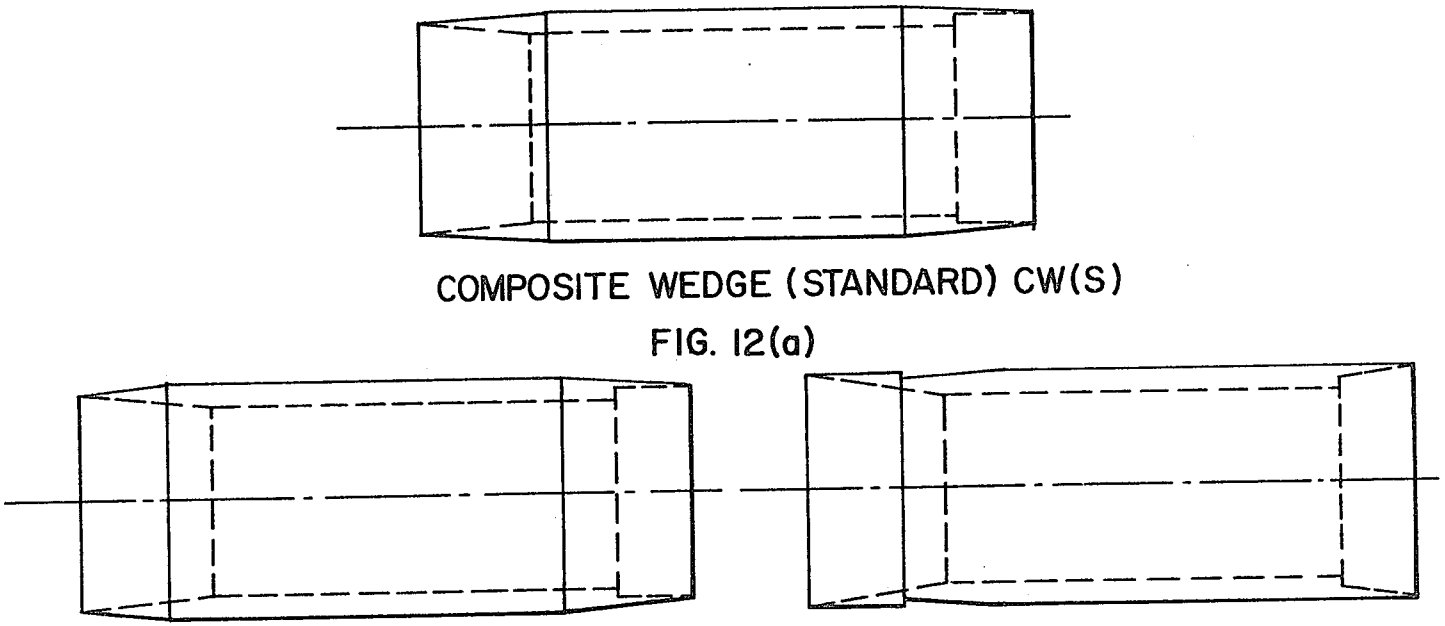
Figure 13:
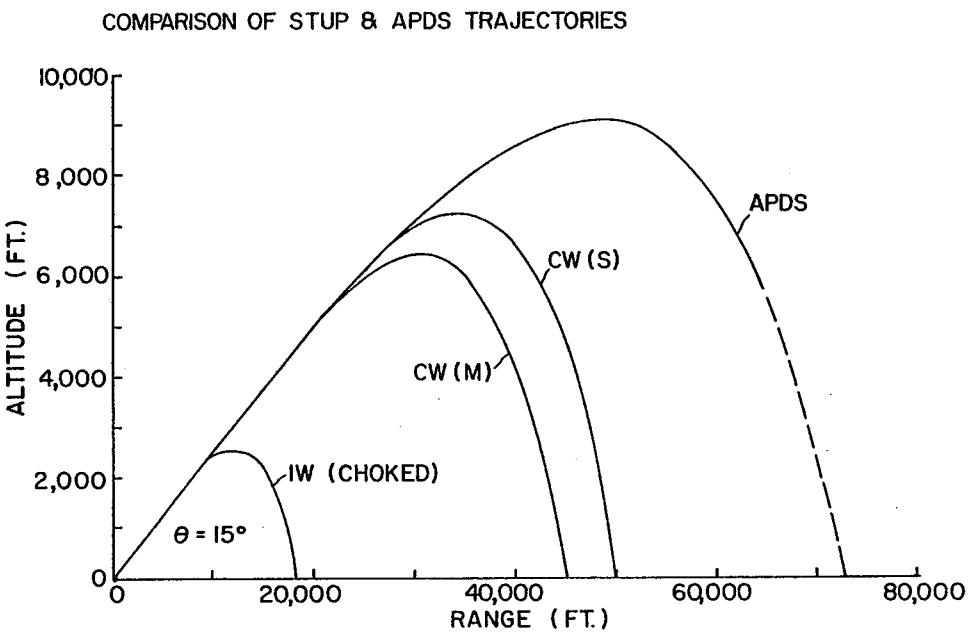
Figure 14:
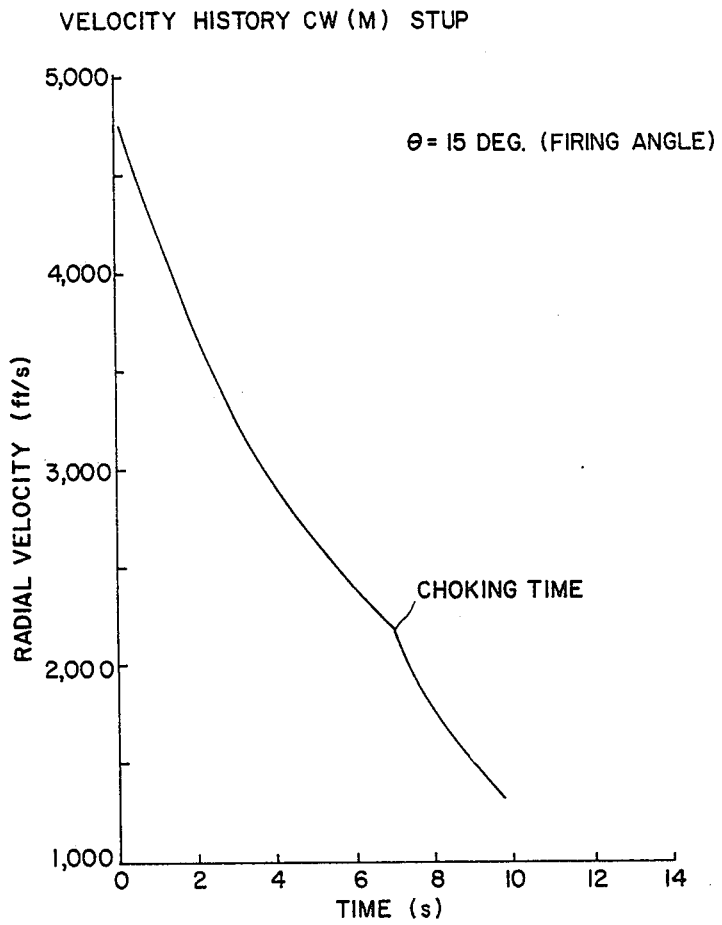
Figure 15:
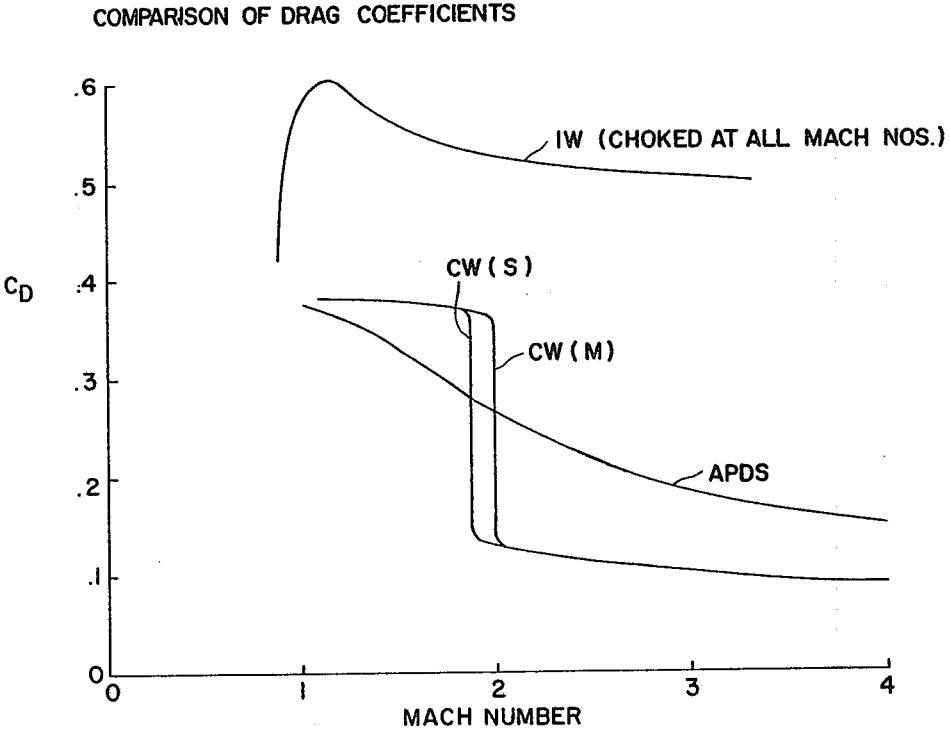
Figure 16:
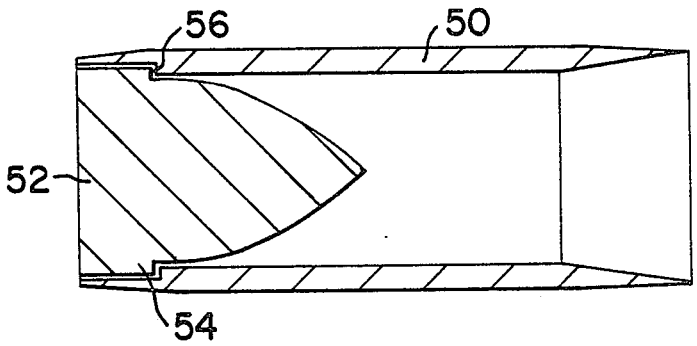

FIGS. 6(*a*) to 6(*d*) illustrate the shock swallowing and shock expelling features of a projectile made in accordance with the present invention;

FIG. 7 is a graph bearing curves illustrating the effect of throat to intake area ratio on the shock expelling and swallowing processes at various flight Mach numbers;

FIG. 8 is a graph illustrating typical drag coefficient variation in relation to Mach number at several wall thickness ratios for a typical tubular projectile;

FIG. 9 is a graph illustrating the variation of ballistic coefficient with wall thickness ratio at various flight Mach numbers for a typical tubular projectile;

FIG. 10 is a schematic view of a portion of a tubular projectile with symbols applied thereto illustrating the various dimensions of the projectile;

FIG. 11 is a portion of a test report which shows points of strike of projectiles on a target;

FIGS. 12(*a*) to 12(*c*) illustrate various tubular projectile configurations used in field trials;

FIG. 13 is a plot of the trajectories of various projectiles;

FIG. 14 is a plot of the velocity history of the projectile shown in FIG. 12(*b*);

FIG. 15 illustrates the drag coefficient variation with flight Mach number for a plurality of projectile configurations;

FIG. 16 is a longitudinal section view of a modified form of projectile;

Before describing the theoretical considerations governing the design of the tubular projectile, reference will now be had to FIGS. 1–3 which illustrate a typical embodiment of the invention. FIG. 1 shows the assembly complete including the projectile body 10, driving band 12, pusher base 14 and front protective cover 16. Front cover 16 is, of course, removed prior to launch. FIGS. 2 and 3 illustrate the flight configuration of the projectile i.e. the projectile body 10, per se.

The projectile body 10 is of circular cross-section and has a central passageway 18 therein of circular cross-section. The frontal portion of the body 10 is shaped to define an annular composite wedge portion 20. This composite wedge portion includes an internal wedge having an annular wall 22 which is at an angle to the longitudinal axis of the projectile and thus tapers inwardly from the leading edge 26 of the projectile to a throat portion 25 which commences at region 24, and an external wedge having an annular wall 28 which is also at an angle to the axis of the projectile and thus tapers outwardly and rearwardly from the leading edge 26 to the region 30 where it meets the cylindrical outer wall 32 of the projectile. The throat portion 25 is of constant diameter from 24 to the trailing end 28 of the projectile. The apex of the annular internal and external wedges actually lies a short distance forwardly of the leading edge 26 due to the fact that the latter is rounded to a very small radius, as seen in cross section, for practical reasons.

The trailing end section of the projectile is stepped inwardly at 30 and the exterior wall of the stepped-in portion is knurled to provide a good grip between the projectile 10 and the annular driving band 12 which is press fitted tightly over the inwardly stepped portion. The driving band 12 includes an annular recess 32 which retains pusher base 14 in position. The trailing edge of driving band 12 includes an annular lip 13 which acts as a gas seal during launching.

The pusher base 14 abuts against the trailing end 28 of projectile 10 and includes an annular projection 36 thereon having a groove therein containing an annular sealing ring 38. Ring 38 helps to prevent blow-by of gases during the launching of the projectile. As is well known in the art, the pusher base functions to transform gaseous pressure within the launch tube or gun barrel to a driving force which accelerates the projectile assembly for launching. The driving band 12, being of relatively soft material, (such as a suitable plastics material) engages the riflings formed in the gun barrel and imparts spin to the projectile thereby to help stabilize same during flight. After launching, centrifugal forces effect separation of the driving band 12 following which the stagnation pressure which builds up in the interior of the projectile act to force the pusher base 14 off the projectile.

Figure 4:
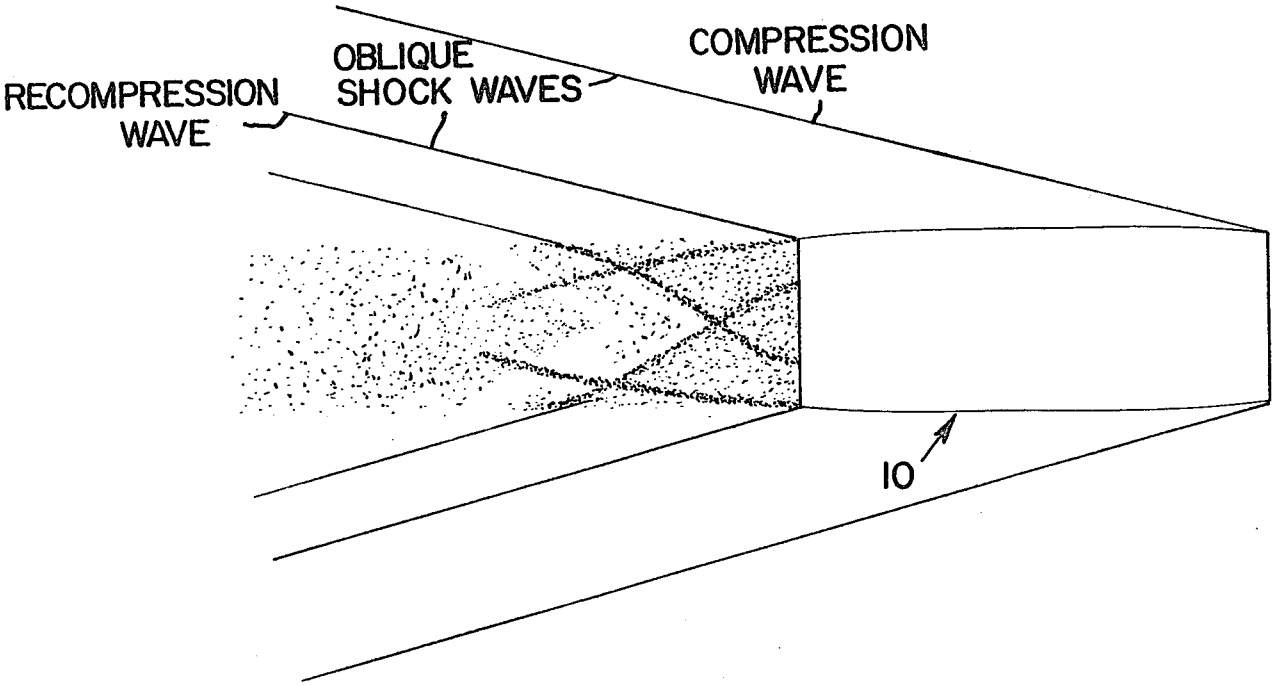
FIG. 4 shows the projectile in flight with oblique shock waves attached to the leading and trailing ends thereof.

The tubular projectile 10 is intended to be launched at supersonic velocities, usually between Mach 4 and 4.5. Thus, supersonic flow fields are associated with the tubular projectile 10, and these can have two different structures. At the higher velocity ranges, the flow field establishes an oblique shock wave structure (providing the throat to intake area ratio ($A_t/A_i$) is large enough as will be explained fully hereafter in which a compression shock wave is attached to the leading edge 26, is followed by a region of expansion, and then by a recompression shock wave attached to the trailing edge 28. Such an oblique shock wave structure can be seen, for instance, in FIG. 4. A supersonic flow field in which an oblique shock wave structure is formed associated with supersonic flow inside the tubular projectile is associated with low drag forces.

Figure 5:
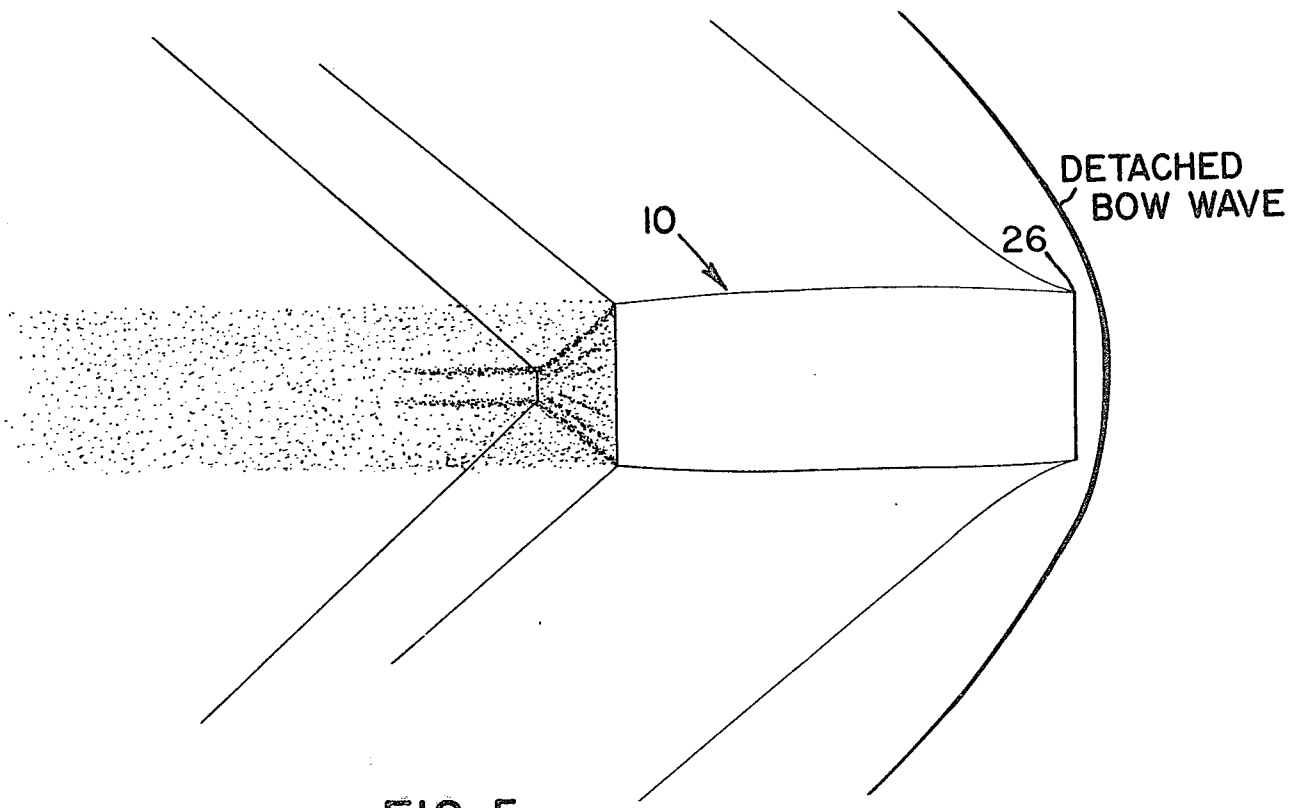
FIG. 5 is a view similar to FIG. 4 but showing a normal shock wave ahead of the projectile.
Figure 6A:
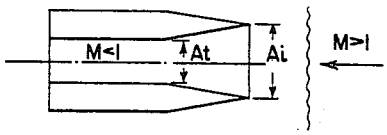
Figure 6B:
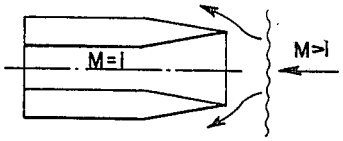
Figure 6C:
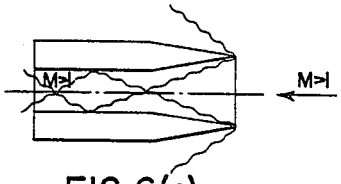
Figure 6D:
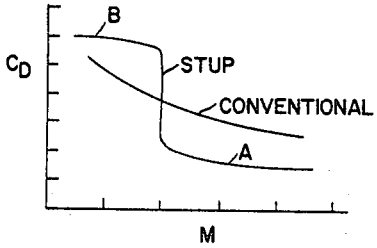

The velocity of the projectile decreases with range and at a predetermined Mach number, which depends on the $A_t/A_i$ ratio, the flow field associated with the projectile 10 suddenly changes to one exhibiting a strong normal shock wave (or bow wave) that is detached from the leading edge 26 of the tubular projectile 10. This is best seen at FIG. 5. The presence of a strong normal shock wave detached from the leading edge 26 indicates that choked flow conditions exist within that projectile. Choked flow conditions tend to give the impression that the projectile is a solid cylinder, and in any case, impose large drag forces on the projectile.

The choking phenomena of the tubular projectile has been substantiated in wind tunnel tests using models and flow visualization techniques and has been further demonstrated in actual field trials. It is thus possible in accordance with this invention to increase the drag forces on the tubular projectile considerably, and suddenly. It is also possible to tailor the design configuration of the tubular projectile in such a way as to provide low drag over the first portion of the range that is to be followed by a natural transition at a predetermined threshold or critical velocity (and Mach number) to choked flow conditions which impose very high drag forces on the projectile and so limit its range of flight. The utility of this transition feature will become more apparent hereafter.

The basic structural and functional features of a typical projectile made in accordance with the principles of the invention have been briefly described above. The following description will illustrate various important theoretical and practical considerations involved in the design of a typical spin stabilized tubular projectile (given the acronym STUP for convenience) to be used as a practice round, which practice round is to be used to simulate a typical APDS (armour piercing discarding sabot) projectile. The description will make specific reference to the design of a 105 mm. projectile but it is to be understood that the invention is not to be limited to this size, but rather extends to all practical sizes.

It should be understood that the flow properties of a STUP are somewhat more critical than for conventional ogive shapes. Specific design criteria has to be well understood and used in the basic designs to fulfill the objectives. A STUP designed as a practice round for 105 mm APDS training, for example, has to have several important features such as: (a) trajectory match with the APDS in practice distances up to 2500 meters; (b) small safety range; (c) minimum richochet range; and (d) low cost.

The most important parameter to consider in the initial design phase is the trajectory match with the APDS. In theory, this is achieved by matching precisely the launch, inertial properties, aerodynamic and dynamic stability properties of the practice round with the APDS (i.e. APDS is the weapon). In practice, this is not possible even with a STUP. So, a compromise in the above design goals has to be considered to achieve an acceptable trajectory match with the APDS. This is a compromise between the muzzle velocity, ballistic coefficient $C_DA/W$, ($C_D$=drag coefficient, A=area of projectile based on maximum outside diameter of flight configuration, W=total weight of projectile-flight configuration), time of flight, inertial properties and dynamic stability. To achieve low cost the design calls for a projectile with the minimum number of components, which dictates a full-calibre round (i.e. the APDS is sub-calibre and it has a complicated and expensive sabot).

To achieve a trajectory match of the APDS with a full-calibre STUP, the drag must be low and it is imperative that supersonic flow be started in the central passageway of the projectile as soon as the round leaves the gun muzzle; otherwise, the drag will be too high. The flow starting process, also termed the shock swallowing process, is described below and can be used to establish a minimum throat to intake area ratio based on the maximum muzzle Mach number. Reference should now be had to the FIGS. 6(*a*) and 6(*b*) and the graphs shown in FIGS. 6(*d*) and 7. FIG. 6 schematically illustrates a tubular projectile in accordance with the invention having a composite annular leading end wedge defining an inlet area $A_i$ and a throat area in the central passageway designated by $A_t$.

The internal flow process of a STUP is basically that of a supersonic diffuser and the reverse De Laval nozzle. Since the flow is starting from rest at the muzzle of the gun, a normal shock wave has to pass through the throat section to establish supersonic flow in the central passageway and thus low drag conditions.

The starting or shock swallowing process involves a consideration of the governing equations for mass continuity, momentum, and energy. Reference may be had to the following:

A. Hermann, "Aerodynamics of Supersonic Diffusers."

B. Donovan, A. F., Lawrence, H. R., "Aerodynamic Components of Aircraft at High Speed," Princeton University Press, 1957.

C. Shapiro, H., "Compressible Fluid Flow," Vol. I, The Ronald Press Company, New York.

As the flow (shown by the arrow) accelerates to supersonic speeds, a normal shock appears in front of the inlet as shown in FIG. 6(*a*). As the Mach number increases the normal shock moves towards the inlet edge. The flow behind the shock wave is subsonic and accelerates towards Mach number one at the throat section. The amount the flow accelerates depends on the geometry or the area ratio between the inlet and throat. At some higher Mach number the shock wave will become attached to the inlet edge. At this condition the Mach number at the throat is one or less. If the shock wave moves inside the edge, even just a small distance, it will be 'swallowed' since it can be shown that this is an unstable region and thus supersonic flow conditions are established. However, if the throat Mach number reaches one before the shock wave is attached to the edge it means that the Mach number is one at the throat and the flow is choked. The additional mass flow escapes around the edge as shown in FIG. 6(*b*). Even if the Mach number is increased further the shock will never reach the edge and the flow will not start. This is the condition for high drag.

The equation which defines the minimum theoretical throat to intake area ratio for starting can be derived from the governing equations which yield:

$$\left(\frac{A_t}{A_i}\right)_{min} = \frac{\left(1+\frac{\gamma-1}{2}M^2\right)^{1/2}\left(\gamma M^2-\frac{\gamma-1}{2}\right)^{1/\gamma-1}}{\left(\frac{\gamma+1}{2}M^2\right)^{\gamma+1/2(\gamma-1)}}$$

where:

$\gamma$=ratio of specific heats

M=Mach number (M>1.0) at launch or muzzle velocity

This equation defines curve A on FIG. 7.

The above equation and the curve shown in FIG. 7 can readily be used to determine the minimum theoretical throat to inlet area ratio ($A_t/A_i$) necessary to obtain supersonic flow in the central passageway at the launch velocity. However, in practice, the minimum ($A_t/A_i$) ratio is always chosen so as to be somewhat greater than that indicated by the equation since the boundary layer has the effect of making the throat area slightly smaller. To illustrate this, we will consider the ($A_t/A_i$) ratio needed for a tubular projectile which is being designed to match (approximately) the flight characteristics of a 105 mm APDS. The muzzle velocity of the 105 mm APDS is 4850 ft/s (1478.3 m/s) or Mach number 4.3. From the plot of $A_t/A_i$ versus Mach number, for the flow to start, the $A_t/A_i$ ratio has to be at least 0.66. As noted above, this design criteria does not account for the boundary layer thickness which affects the effective minimum throat area. In the STUP model shown in FIGS. 1-3 the minimum throat area would be at the very rear face of the model as the boundary layer thickness increases with length and depends to some extent on ambient conditions as well, particularily the temperature. Thus, the STUP design has to have an $A_t/A_i$ ratio which is larger than 0.66 for the flow to start. For the STUP Model in question an $A_t/A_i$ ratio of 0.7 was selected. Generally speaking, an $A_t/A_i$ ratio some 5% or 6% greater than the theoretical minimum given by the equation is sufficient to account for the boundary layer thickness.

It should be noted that the ($A_t/A_i$) ratio design margin is relatively small for most existing gun systems. This margin in the $A_t/A_i$ ratio for launch Mach numbers from 1 to 4.3 is 1 to 0.66, excluding boundary layer considerations. The $A_t/A_i$ ratio for launch Mach numbers of 1 to 5 is 1 to about 0.65, also excluding boundary layers considerations. For $A_t/A_i$ values below these limits the flow will not start at launch and the drag will be high. Since the $A_t/A_i$ ratio is the square of the throat to intake diameter ratio $(d_t/d_i)^2$, it can be observed from examination of the STUP model shown in FIGS. 1 to 3, for example, that the difference between the throat and intake diameter is relatively small. The ($A_t/A_i$) ratio is also of great significance in limiting the range of the projectile. The process by which the projectile of the invention "expels" the shock wave and thus establishes choked flow conditions within the central passageway at a predetermined Mach number will now be described.

With the condition of the flow started the Mach number throughout the central passageway is supersonic as shown in FIG. 6(*c*). Contrary to subsonic flow, the Mach number in the converging section decreases towards the throat and its value is also related to the throat to intake area ratio. As Mach number decreases (i.e. as the projectile loses speed in flight) towards one at the throat, the shock wave will appear in the throat, but it will be coming from the rear or trailing edge of the projectile. At a slightly lower Mach number, the shock wave will move into the converging section and this being an unstable condition, it will only stablize itself in front of the projectile as shown in FIG. 6(*a*). This is the high drag condition which is required to decrease the range. The equation which defines the shock expelling process as a function of Mach number is as follows:

$$\frac{A_t}{A_i} = \frac{M}{\left(\frac{1+\frac{\gamma-1}{2}M^2}{\frac{\gamma+1}{2}}\right)^{\gamma+1/2(\gamma-1)}}$$

(M=flight Mach number $\gamma$=ratio of specific heats)

This equation defines curve B on FIG. 7.

The above described processes of swallowing and expelling the shock at selected Mach numbers has application in most direct fire gun systems where the overall range of the weapon is large with respect to the maximum target range (e.g. a 105 mm Tank Gun). In general, these processes provide for low drag (flow started) over the first part of the flight path to the target followed by a sudden transition to high drag (shock expelled) conditions to reduce the range.

Thus, by virtue of the shock swallowing and expelling feature of the invention, a STUP (or tubular projectile) can be designed with a much lower drag coefficient than a conventional projectile at high Mach numbers (at A in FIG. 6(*d*). At a predetermined Mach number the coefficient of drag $C_D$ rises sharply to a high level (at B in FIG. 6(*d*). These features help one to tailor the design of the STUP to a selected drag curve. (For some applications this may be relatively easy while it is more difficult for others which call for very low drag and a high choking Mach number.)

Returning again to the practical example of the 105 mm Tank Gun STUP Practice Round, an ($A_t/A_i$) ratio of 0.7 was selected so as to provide for swallowing of the shock at start-up or launch. From the plot of ($A_t/A_i$) vs. Mach number-in-FIG. 7 it can be seen that for this model, choking will occur at about Mach 1.8 or somewhat greater (depending on boundary layer effects). Reference to various tests carried out, which verify that this choking effect does take place as predicted, will be made later on in this disclosure.

With further reference to FIG. 7 (curve B) it will be noted that as the ($A_t/A_i$) ratio approaches one, the Mach number at which choking occurs also approaches one. If the central passageway through the projectile is simply a uniform diameter bore, i.e. if no "throat" is provided, choking will not occur at all at supersonic velocities (assuming no boundary layer effects); hence it is essential that the projectile have an internal configuration arranged such that the choking phenomena can take place e.g. by providing an annular internal wedge or some other configuration capable of producing a contraction of the flow. A composite leading end wedge is desirable in most cases as it can readily be tailored to provide the desired flow pattern but it should be realized that a fully operable projectile can be designated with an external surface which is cylindrical or even slightly tapered throughout its length toward the trailing end.

Further important considerations are the wall thickness ratio t/R (where t=maximum wall thickness and R=one half maximum outside diameter of projectile), and the size of the wedge angle(s) at the leading end of the projectile. The wedge angles should be kept reasonably small to ensure that attached oblique shock conditions at the leading edge are achieved to minimize pressure drag. In the case of a composite wedge design as shown in FIGS. 1-3 the included angle $\theta$ (see FIG. 2) between the inside and outside wedges should be less than about 15° and better still less than about 10°. At the same time the included angle will usually be greater than about 5°. In the case of a design having an internal leading end wedge only it is recommended that the wedge angle (i.e. the angle between the annular wall defined by the wedge and the projectile axis) be less than about 10°, and preferably from about 3° to 5°. An overly blunt leading edge may result in detached shock wave conditions and high drag so therefore the leading edge should be resonably sharp; a "knife edge" leading edge however is not necessary and for practical purposes the edge may be rounded off to a small radius, e.g. 0.005 inches, to reduce the possibility of edge damage during handling.

It is known in the art that the range of a projectile is decreased by increasing the ballistic coefficient $C_DA/W$. In a tubular projectile, the coefficient of drag $C_D$ is increased by increasing the wall thickness. Increasing the wall thickness also increases the weight. There is, for any particular tubular projectile, a wall thickness ratio t/R where $C_DA/W$ is optimum and the retardation during flight is minimum. The wall thickness ratio t/R is a parameter which is therefore useful in expressing the various relationships which exist.

The wall thickness ratio (t/R) is chosen so as to achieve a minimal ballistic coefficient $C_DA/W$. From tests of various tubular projectiles, curves relating drag coefficient $C_D$, Mach number and (t/R) have been developed. FIG. 8 shows generally the type of relationship existing between these variables for tubular projectiles of the type being discussed herein. Experience has shown that (t/R) should be between about 0.15 and 0.45 in order that the drag coefficient may remain within acceptable limits. A graph illustrating generally the relationships between the ballistic coefficient $C_DA/W$ and thickness ratio (t/R) for tubular projectiles of the type being discussed herein is given in FIG. 9 which further illustrates the importance of selecting the appropriate thickness ratio so as to minimize the ballistic coefficient. (The curves shown in FIGS. 8 and 9 will vary depending on the exact configuration of the projectile and are given here only for purposes of illustration).

The flight weight W of the projectile is dictated by the interior ballistic limits of the gun system. In the example we are considering (the 105 mm STUP Practice Round, for the 105 mm Tank Gun L7A1, the maximum shot weight of the APDS (projectile plus sabot) allowable to achieve a muzzle velocity of 1478.3 m/sec is about 13 lbs. In this case then, the shot weight of the STUP practice round (projectile plus pusher base and rider band etc.) cannot exceed 13 lbs if the initial velocity of the tubular projectile is to match that of the weapon which it is designed to simulate.

Another important phase of a STUP design procedure is estimating the dynamic stability. This involves the ratio between the gyroscopic and aerodynamic moments. In summary, the gyroscopic stability factor must be greater than one for the projectile to be dynamically stable. The gyroscopic stability factor Sg is defined as follows:

$$Sg = I_x^2 p^2 / 4\, I_y \mu$$

where $$\mu = (\pi/8)\, \rho d^3\, V^2\, C_{m\alpha}$$

and $I_x$—axial moment of inertia
$I_y$—transverse moment of inertia
P—angular velocity
$\rho$—air density
d—max. body diameter
V—velocity at the muzzle
$C_{m\alpha}$—static moment coefficient In the 105 mm Tank Gun L7A1 for example, the parameters p, $\rho$, V would be the same for both STUP and the APDS. But the value of $I_x$ is much greater for a full-calibre STUP than a sub-calibre APDS while $I_y$ would be of the same order. Then from the equation above the ratio $(I_x^2/I_y)$ would be much larger for STUP than the APDS. The value of $C_{m\alpha}$ is very difficult to estimate but it is of the same order for both projectiles. Then it can be shown that the 105 mm STUP Practice Round has a much larger Sg (i.e. $Sg >> 1$) than the APDS and this has to be considered in the trajectory match. The STUP tends to fly a flatter trajectory so it does not fall vertically as much as the APDS with range. The fineness ratio l/d (where l=projectile length and D=maximum outside diameter is theoretically limited by the maximum allowable stability factor Sg. In practice the l/D ratio may vary from about 2 to about 5. Finally, in the process of matching the trajectory of the APDS with STUP, a compromise between muzzle velocity, time of flight, ballistic coefficient and dynamic stability is made and this is achieved through theoretical estimation and full scale experimental iteration techniques.

The basic equations for determining the drag coefficient and the ballistic coefficient are given below. These equations may be used in a simple computer code e.g. (APL language) to arrive at a design which fulfills the trajectory requirements. It should be emphasized that the invention is not to be limited to any particular method of computation. Conventional mathematical techniques based on known aerodynamic principles may be employed to optimize the design; however, the summary of the governing equations involved and the simple computer code used will be of assistance to those skilled in the art in designing a STUP to meet a particular set of requirements. Reference is had to FIG. 10.

The basic aerodynamic principles may be had from the following references:

A. Ames Research Staff, "Equations, Tables and Charts for Compressible Flow," NACA Report 1135, 1953.

B. Hoerner, S., "Fluid-Dynamic Drag."

C. NACA RM L53C02.

The nomenclature to be used in the governing equations is as follows:

L=Projectile length
$D_i$=Intake Diameter
$D_t$=Inside or throat diameter
$D_o$=Outside Diameter
t=Wall thickness
R=One half outside diameter $D_o$
$\theta_o$=Outside wedge angle
$\theta_i$=Inside wedge angle
A=Reference Area ($\pi D_o^2/4$)
M=Mach Number
V=Velocity
$\gamma$=Ratio of Specific Heats
$C_p$=Coefficient of Pressure
$C_{Dp_o}$ =Coefficient of Pressure Drag—Outside Wedge
$C_{Dp_i}$ =Coefficient of Pressure Drag—Inside Wedge
$C_f$=Coefficient of Friction
$R_e$=Reynolds Number
$C_{PB}$=Coefficient of Base Pressure
$\rho$=Air Density
$\mu$=Air viscosity The following assumptions are made in the mathematical analysis:

(a) Two-dimensional fluid flow (only valid for $t/R<0.5$).
(b) Oblique shock wave attached to leading edge of projectile.
(c) No choking i.e. supersonic flow in central passage of the projectile.
(d) Zero angle of attack.
(e) Geometry as shown in FIG. 10 (single or composite wedges).

The coefficient of drag ($C_D$) is expressed as follows:

$$C_D = C_{DP}\,(\text{pressure}) + C_{Df}\,(\text{friction}) + C_{DB}\,(\text{base})$$

The coefficients are based on total projected area ($\pi D_o^2/4$).

(a) Pressure Drag Coefficient ($C_{Dp}$) is expressed as follows:

From Ref. A for a two-dimensional wedge $$C_p = \frac{2}{(M^2-1)^{1/2}}\theta + \frac{(\gamma+1)M^4 - 4(M^2-1)}{2(M^2-1)^2}\theta^2 + \frac{1}{(M^2-1)^{7/2}}\left[\frac{(\gamma+1)^2}{16}M^8 - \frac{7+12\gamma-3\gamma^2}{12}M^6 + \frac{3}{2}(\gamma+1)M^4 - 2M^2 + \frac{4}{3}\right]\theta^3 + \ldots$$

For the outside wedge ($\theta=\theta_o$)

$$C_{Dp_o} = C_{po}\left[1 - \left(\frac{D_i}{D_o}\right)^2\right]$$

For the inside wedge ($\theta=\theta_i$)

$$C_{Dp_i} = C_{po}\left[\frac{D_i^2 - D_t^2}{D_o^2}\right]$$

$$\text{and } C_{Dp} = C_{Dp_o} + C_{Dp_i}$$

(b) Skin Friction Drag Coefficient ($C_{Df}$) is given by the following:

From Ref. B for tubulent flow $$C_f = K\,C_f'$$

where $$K = (1+0.15\,M^2)^{-0.432}$$

$$C_f' = (3.46\,\text{Log}_{10}R_e - 5.6)^{-2}$$

$$R_e = \rho V L/\mu$$

The skin friction is based on wetted area $S_W \simeq \pi L(D_o+D_t)$ and $$\text{and } C_{Df} = C_f' L\left[\frac{D_o+D_t}{D_o^2}\right]$$

(c) Base Drag Coefficient ($C_{DB}$) is determined as follows:

The base pressure coefficient for a two-dimensional body is given in Ref.C. Base drag data was also obtained in wind tunnel tests using 105 mm models. The wind tunnel results correlated well with the data of Ref.C. The following function was derived from the data:

$$C_{PB} = A_0 + A_1M + A_2M^2 + A_3M^3 \quad 1.5 \leqq M \leqq 4.5$$

where $A_0$=0.6331
$A_1$=−0.33257
$A_2$=0.06619
$A_3$=−0.004 and $$\text{and } C_{DB} = C_{PB}\left[1 - \left(\frac{D_t}{D_o}\right)^2\right]$$

Other Formulas which are well known to those skilled in the art are as follows:

Ballistic Coefficient $$\frac{C_DA}{W}\ (\text{ft}^2/\text{lb})$$

Retardation $$\frac{dV}{dX} = (16.1\,\rho\,V\,C_DA)/W\ (\text{ft/sec/ft})$$

The above equations have been used in a computer program (APL Language) and for convenience the program listing is given below

APL LISTING

INPUT DATA (lines 1, 2 and 4)

| | |
|---|---|
| L | - Model Length (in) |
| DO | - Model Outside Diameter (in) |
| TOR | - Wall Thickness Ratio (t/R) |

-continued

APL LISTING

| | |
|---|---|
| AOR | - Intake area Ratio ($A_t/A_i$) (Area of throat/Area of intake) |
| TETAO | - Outside Wedge Angle (deg) |
| TETAI | - Inside Wedge Angle (deg) |
| DENS | - Material Density (lb/in$^3$) |
| PITCH | - Gun Rifling Pitch (ft) |
| RHO | - Atmospheric Density (.002378 slugs/ft$^3$) |
| MU | - Viscosity ($3.719 \times 10^{-7}$ slugs/ft sec) |
| S | - Speed of Sound (1117 ft/sec) |
| VEL | - Velocity (ft/sec) |
| $A_0,A_1,A_2,A_3$ | - Constants in the polynomial that defines the base drag coefficient |

OUTPUT DATA (Lines 57 to 62

| | |
|---|---|
| T | - Wall Thickness (in) |
| DT | - Inside or Throat Diameter (in) |
| DI | - Intake Diameter (in) |
| TO | - Thickness Outside Intake Diameter (in) |
| TI | - Thickness Inside Intake Diameter (in) |
| LOD | - Model Fineness Ratio |
| $L_1$ | - Length of Outside Parallel Section (in) |
| $L_2$ | - Length of Outside Wedge (in) |
| $L_3$ | - Length of Inside Wedge (in) |

-continued

APL LISTING

| | |
|---|---|
| $L_4$ | - Length of Inside Parallel Section (in) |
| V | - Material Volume (in$^3$) |
| W | - Model Weight (lb) |
| CPO | - Coefficient of Pressure - Outside Wedge |
| CDPO | - Coefficient of Pressure Drag - Outside Wedge |
| CPI | - Coefficient of Pressure - Inside Wedge |
| CDPI | - Coefficient of Pressure Drag - Inside Wedge |
| CDP | - Coefficient of Pressure Drag |
| RE | - Reynolds Number |
| CF | - Coefficient of Friction |
| CDF | - Coefficient of Friction Drag |
| PPB | - Base Pressure Coefficient |
| CDB | - Coefficient of Base Drag |
| M | - Mach Number |
| CD | - Coefficient of Drag |
| CDA | - Ballistic Coefficient (ft$^2$/lb) |
| VELD | - Velocity Retardation (ft/sec/100 ft) |
| SPIN | - Angular Velocity (rev/sec) |
| VT | - Tangential Velocity (ft/sec) |
| STRESS | - Trangential (hoop) Stress (lb/in$^2$) |

Note:
Reference area used in the aerodynamics is based on outside diameter.

APL LISTING

```
      VSTUP2[O]V    Model 26
      VSTUP2
[1]   L,DO,TOR,AOR,TETAO,TETAI,DENS,PITCH
[2]   RHO,MU,S,VEL
[3]   M←VEL÷S
[4]   A0,A1,A2,A3
[5]   DELO←TETAO×01÷180
[6]   DELI←TETAI×01÷180
[7]   T←TOR×DO÷2
[8]   DT←DO−2×T
[9]   DI←DT×(1÷AOR)*.5
[10]  TO←(DO−DI)÷2
[11]  TI←(DI−DT)÷2
[12]  L2←TO÷30DELO
[13]  L3←TI÷30DELI
[14]  L1←L−L2
[15]  L4←L2−L3
[16]  V1←(01×L1÷4)×(DO*2)−DT*2
[17]  V2←.2618×L2×(DO*2)+(DO×DI)+DI*2
[18]  V3←.2618×L3×(DI*2)+(DI×DT)+DT*2
[19]  V4←01×L4×(DT*2)÷4
[20]  V←V1+V2+(−V3)−V4
[21]  W←DENS×V
[26]  M2←(M*2)−1
[27]  CP1←2÷M2*.5
[28]  CP2←((2.4×M*4)−4×M2)÷2×M2*2
[29]  CP3←(1÷(M2*(7÷2)))×(.36×M*8)−(1.493×M*6)+(3.6×M*4)−(2×M*2)+4÷3
[30]  CPO←(CP1×DELO)+(CP2×DELO*2)+CP3×DELO*3
[31]  CDPO←CPO×1−(DI÷DO)*2
[32]  CPI←(CP1×DELI)+(CP2×DELI*2)+CP3×DELI*3
[33]  CDPI←CPI×((DI*2)−DT*2)÷DO*2
[34]  CDP←CDPO+CDPI
[36]  RE←RHO×VEL×(L÷12)÷MU
[37]  CFP←((3.46×(10*RE))−5.6)*−2
[38]  K←(1+.15×M*2)*−.432
[39]  CF←K×CFP
[40]  CDF←CF×4×L×(DO+DT)÷DO*2
[41]  PPB←AO+(A1×M)+(A2×M*2)+A3×M*3
[42]  CDB←PPB×1−(DT÷DO)*2
[43]  CD←CDP+CDF+CDB
[44]  CDA←(CD×01×(DO*2)÷4)÷W
[45]  CDA←CDA÷144
[46]  VELD←16.1×RHO×VEL×CDA×100
[47]  SPIN←VEL÷PITCH
[48]  SPINR←SPIN×2×01
[49]  VT←SPINR×DO÷24
[50]  STRESS←(DENS×(VT*2)÷32.2)×12
[51]  LOD←L÷DO
[57]  T,DT,DI,TO,TI,LOD
[58]  L1,L2,L3,L4,V,W,VC,WCS,WCT
[59]  CPO,CDPO,CPI,CDPI,CDP
[60]  EE,CF,CDF
[61]  PPB,CDB
[62]  M,CD,CDA,VELD
```

-continued

APL LISTING

V

| Example Model 26 | |
|---|---|
| Input | (1)10 4.127 0.2125 0.7 3 3.5 0.282 6.25 |
| | (2)0.002378 3.719E−7 1117 4850 |
| | (4)0.63331 −0.33257 0.06619 −0.004 |
| Output | (57)0.4385 3.25 3.8845 0.12125 0.31725 2.4231 |
| | (58)7.6863 2.3137 5.1869 −2.8733 40.082 11.303 0.42706 0.12043 0.12043 |
| | (59)0.02835 0.0032339 0.033815 0.0089873 0.012221 |
| | (60)2.5843E7 0.0013934 0.02414 |
| | (61)0.10973 0.041681 |
| | (62)4.342 0.078042 0.0006414 11.91 |

By following an iterative procedure on those input parameters which can be varied e.g. TOR, TETAO, TETAI, the following data was produced:

| | |
|---|---|
| (See Input Data) | |
| L ← 10.0 | or L = 10.0 ins. |
| DO ← 4.127 | or $D_o$ = 4.127ins = 105 mm |
| TOR ← 0.213 | or t/R = 0.213 |
| AOR ← 0.7 | or $A_t/A_i$ = 0.7 |
| TETAO ← 3 | or $\theta_o = 3^o$ |
| TETAI ← 3.5 | or $\theta_i = 3.5^o$ |
| DENS ← .282 | = (mat.dens.)=.282 lb/in.$^3$ |
| PITCH ← 6.25 | = (rifling pitch)=6.25 ft. |
| RHO ← .002378 | = (atoms density in slugs/ft.$^3$) |
| MU ← 3.719E$^{-7}$ | = (air viscosity)3.719×10$^{-7}$ slugs/ft.sec. |
| S ← 1117 | = (speed of sound)1117 ft/sec. |
| VEL ← 4850 | = (muzzle velocity)4850 ft/sec. |
| $A_0,A_1,A_2,A_3$ ← .6331, −.33257,.06619,−.004 | |
| and (See Output Data) (Partial Listing Only) | |
| DT ← 3.250 | or throat diameter = 3.250 ins. |
| DI ← 3.88 | or intake diameter = 3.88 ins. |
| LOD ← 2.42 | or fineness ratio ($L/_D$) = 2.42 |
| $L_1$ ← 7.81 | or length of outside parallel section = 7.81 ins. |
| $L_2$ ← 2.29 | or length of outside wedge = 2.29 ins. |
| $L_3$ ← 5.19 | or length of inside wedge = 5.19 ins. |
| W ← 9.88 | or weight of projectile = 9.88 lbs. |

The remaining output data is not given here. The above partial listing gives the basic parameters for the 105 mm STUP Practice Round design being considered here by way of example. It will be noted here that the optimum wall thickness ratio (t/R) is calculated to be 0.213; the optimum wedge angles were found to be 3 deg. for the outside wedge and 3.5 deg. for the inside wedge. Other pertinent dimensions are given above. These dimensions were applied to the particular embodiment shown in FIGS. 1 to 3 to provide a successful 105 mm practice round. The material used for the projectile was AISI 1018 hard drawn steel. The leading edge 26 shown in FIG. 2 was rounded off to a small radius (i.e. 0.005 in. radius).

The accuracy of the STUP as compared with conventional projectiles i.e. APDS and TPDS (Target practice discarding sabot) has been demonstrated in various trails. The following is a portion of a test record, relating to the development testing of the 105 mm STUP described above.

Weapon used: 105 mm Tank Gun

Target: 20′×20′ at 1000 meters

Ammunition:

(1) 105 mm STUP—B Rounds (2) 105 mm APDS/T C35A1—R Rounds (3) 105 mm TPDS/T C-36—W Rounds The test was carried out with the following sight settings: Line—0 mils; Elevation—2.0 mils. The test is outlined in the following table and the points of strike of the test rounds are plotted in FIG. 11. It will be seen that the STUP practice rounds made in accordance with the invention are at least as accurate as the conventional APDS and TPDS rounds.

TABLE

| Rds. No. | Muzzle Velocity meter/sec | Terminal Velocity meter/sec | Point of Strike Horizontal | Point of Strike Vertical | Spin rev/ sec. |
|---|---|---|---|---|---|
| W-1 | 1500.0 | 1287.9 | 10.9 | 11.5 | — |
| W-2 | 1501.4 | 1292.4 | 10.9 | 10.0 | — |
| R-1 | 1468.9 | 1360.5 | 7.7 | 11.3 | 815 |
| B7L1 | 1459.0 | 1316.1 | 10.2 | 13.0 | 774 |
| B7F1 | 1482.9 | 1342.2 | 12.2 | 16.7 | 770 |
| B7F2 | 1478.3 | 1341.9 | 11.4 | 9.0 | 815 |
| B8L1 | 1459.2 | 1327.6 | 10.5 | 11.2 | 789 |
| R-2 | 1474.6 | 1378.7 | 11.0 | 10.9 | 811 |
| B8F1 | 1474.2 | 1340.7 | 12.0 | 13.0 | 854 |
| B8F2 | 1466.6 | 1334.0 | 10.0 | 8.7 | 812 |

Remarks

1-Point of Aim: Hor:10.0 ft. Vert: 10.0 ft.

2-T. of F. measured from 40 meters from muzzle to 3 meters before target.

3-Trunnion height 4′4½″ Height of aiming mark from ground 13′2″.

4-Strike co-ordinates measured from left bottom corner of target.

The criticality of the ($A_t/A_i$) ratio including the choking phenomena has been demonstrated in various trials. Reference will be had to a set of field trials using both conventional APDS projectiles and several varieties of STUP projectiles. FIG. 12 illustrates the several models tested. The models shown in FIGS. 12(*a*) and 12(*b*) were provided with composite leading end wedges, FIG. 12(*a*) with a composite wedge CW(S) and FIG. 12(*b*) with a slightly modified wedge CW(M) while the model of FIG. 12(*c*) was provided only with an internal leading end wedge (IW). The three models of FIGS. 12(*a*), 12(*b*) and 12(*c*) were provided also with external trailing end wedges; this helps to reduce the base drag coefficient somewhat but does not have a substantial effect on the overall performance in flight. The basic dimensions of the several models shown in FIG. 12 are as follows: (See FIG. 10 which illustrates how these dimensions are applied.)

| | FIG. 12(a) CW(S) | FIG.12(b) CW(M) | FIG.12(c) IW |
|---|---|---|---|
| L | 10.0 in. | 10.0 in. | 10.0 in. |
| $L_2$ | 2.12 in. | 1.414 in. | — |
| $L_3$ | 1.878 in. | 2.134 in. | 2.64 in. |
| $D_i$ | 3.578 in. | 3.651 in. | 3.80 in. |
| $D_t$ | 3.050 in. | 3.050 in. | 3.05 in. |
| $D_o$ | 3.800 in. | 3.800 in. | 3.800 in. |
| t | 0.375 in. | 0.375 in. | 0.375 in. |
| R | 1.900 in. | 1.900 in. | 1.900 in. |
| $\theta_o$ | 3° | 3° | 0° |
| $\theta_i$ | 8° | 8° | 8° |
| $A_t/A_i$ | 0.727 | 0.700 | 0.640 |
| t/R | 0.197 | 0.197 | 0.197 |
| L/D | 2.63 | 2.63 | 2.63 |

The models shown in FIG. 12 were all fired at equal velocities under similar conditions and the flight paths tracked with doppler radar. The flight paths were compared with the flight path of a conventional weapon (A.P.D.S.) fired under the same conditions and with the same shot weight. The flight paths of the several projectiles are shown in FIG. 13. The internal wedge model, having an $A_t/A_i$ ratio of only 0.640 was choked at all times and had an overall range of less than 20,000 ft. The two composite wedge models, having $A_t/A_i$ ratios above the critical values were unchoked immediately after launch but became choked at about 7.0 to 7.2 seconds after launch and had ranges of 45,000 ft. approx. for CW(M) and 50,000 ft. approx. for CW(S). The conventional APDS had a range of about 72,000 ft. The velocity history curves of the composite wedge models CW(M) are shown in FIG. 14. The inflection point on the curve demonstrates that choking did occur as predicted. The drag coefficients of the several models shown in FIG. 12 were calculated against flight Mach number and the results are shown in FIG. 15. The two composite wedge models having $A_t/A_i$ ratios of 0.727 and 0.700 respectively show a sharp transition from low to high drag at slightly less than Mach 2 which is in accordance with the theoretical predictions. The internal wedge model (IW) was choked and exhibited high drag at all Mach numbers. The drag coefficient of the APDS showed a gradual increase with decreasing Mach number as anticipated.

As noted previously, the tubular projectile of the invention can be varied in design considerably so long as the basic design criteria established above are observed. For example, the trailing end can be blunt, as shown in FIGS. 1–3 or it can have a relatively sharp edge (see FIGS. 12(*a*), 12(*b*), for example). The internal passageway of the projectile need not be precisely cylindrical, e.g. a small gradual increase in diameter toward the trailing end may be beneficial in certain designs and in like manner the diameter of the exterior surface may be gradually decreased (tapered) toward the trailing end. Usually the degree of taper for the inside and outside surfaces does not exceed 2 or 3 degrees. The leading end of the projectile is preferably provided with a composite wedge as shown in FIGS. 1–3 for example. However, the external leading end wedge is not an essential feature of the invention. In either case the generatrix of the leading wedge portion may be straight, as shown in FIGS. 1 and 2, or curved in some suitable fashion. In all cases however, the $A_t/A_i$ ratio must be large enough to ensure that supersonic flow conditions in the central passageway can be achieved at the launch velocities in question. The provision of a trailing edge may be helpful in many cases where it is desired to reduce the base drag.

The modification shown in FIG. 16 may be useful in certain instances. This projectile 50 is basically the same as that shown in FIGS. 12(*a*), 12(*b*). The embodiment of FIG. 16, however, has a trailing end wedge section adapted to support a pusher base 52 in the form of a conventional non-tubular projectile the leading end portion of same having a conventional ogive shape. Pusher base 52 is configured to have a radially extending shoulder 54 adapted to abut against a bearing seat 56. Although not shown in FIG. 16, it is common for the trailing end wedge on the projectile to releasably carry at least a driver band (not shown) and preferably a sealing ring as well. Such a driver band and sealing ring function in the same manner as described with reference to FIGS. 1–3. Once the tubular projectile 50 has been launched it establishes a normal shock wave just ahead of the leading edge thereof. As a result, high stagnation pressures are established within the central opening of the projectile which pressures cause separation of the pusher base 52. Because the drag forces on the conventional projectile, i.e., the pusher base 52, exceed those on the tubular projectile 50, each projectile will follow its own trajectory. This technique can be used for launching a tubular projectile from an aircraft where the pusher base has to be designed to follow a stable trajectory; otherwise it might be ingested by the engines.

Tubular projectiles as envisaged herein take full advantage of the spin inherent in a spin-stabilized projectile. That spin may be used to inhibit ricochet of the present tubular projectile beyond the desired target area. By providing suitable riflings in the launch barrel or tube, the tubular projectile is launched with a spin rate in the range of about 500 to 1,000 rps (30,000 to 60,000 rpm), and more preferably, in the order of about 750 rps. Rates of spin in this magnitude generate stresses in the shell-like body section which are in the order of 60,000 to 65,000 psi. Naturally, a projectile according to this invention, will be made of a material selected so that the material can withstand the stresses generated by these high rates of spin. Successfully tested prototypes of the tubular projectile have been made of AISI 4340 steel, an annealed alloy steel. Another acceptable type of steel and which is preferred on account of its lower cost, is AISI 1018 steel. The latter is a plain carbon, hard drawn steel having a yield strength in the range of 65,000 to 70,000 psi.

It is highly desirable that the material of which the tubular projectile is made be selected so that the yield strength of same will exceed by only a small margin, the calculatable stresses imposed on the surface of the tubular projectile when launched with the desired rate of spin. When such a spinning tubular projectile encounters a target or other object in the target area, additional loads and stresses due to the impact will be imposed on same and the additional stress generated by the impact will cause failure of the projectile. It has been found that the body section of the tubular projectile will crack, with these cracks being propagated to cause breakup of the projectile in a manner broadly similar to the peeling of a banana. As the projectile body section breaks up in that manner, a greatly increased aerodynamic drag is imposed on the resulting fragments. Consequently, the fragments slow down rapidly, and any tendency for excessive ricochet beyond the target area is severely cut back, and perhaps even eliminated. Most importantly, consistent reliability in controlling unwanted ricochet beyond the target area is obtainable.

I claim:

1. A range limited practice projectile adapted to be fired at supersonic velocity from a gun barrel, and comprising: a tubular body of substantially circular cross-section and 105 mm outside diameter, having a longitudinal axis, a leading inlet end and a trailing exit end and a central passageway extending therethrough, and wherein the leading end of the body is in the form of an annular wedge, the latter being a composite wedge comprising an inside wedge having an annular inner wall, and an outside wedge having an annular outer wall, said inside and outside wedges defining a leading edge of the projectile with the included angle between said inside and said outside annular walls being greater than about 5° and less than about 15° with the included angle between said inner wall and said longitudinal axis simultaneously therewith being greater than about 3° and less than about 10°, the leading edge being sufficiently sharp as to enable an oblique shock wave to attach itself to said leading edge after launching to assist in providing low aerodynamic drag on the projectile, the internal diameter of the central passageway decreasing from the leading inlet end along said annular inner wall to a throat region, the ratio of the cross-sectional area of said passageway in the throat region ($A_t$) to the cross-sectional area of said passageway at the leading inlet end ($A_i$) being sufficiently large and being so related to the projectile velocity at launch as to enable a normal shock wave to pass through the throat region to establish supersonic flow in said passageway and thus provide a relatively low aerodynamic drag after launching, with said ratio $A_t/A_i$ also being a value less than 1.0 so that as the velocity of the projectile decreases to a predetermined flight Mach number, the shock wave is expelled from the passageway to establish choked flow conditions in said passageway and relatively high aerodynamic drag whereby to limit the range of the projectile, and wherein the wall thickness ratio of the projectile t/R is from about 0.197 to not greater than 0.45 where:

t=maximum wall thickness

R=maximum radial distance from projectile axis to outside surface of projectile.

2. A projectile according to claim 1 wherein the ratio of the cross-sectional area of said passageway in the throat region ($A_t$) to the cross-sectional area of said passageway at the leading inlet end ($A_i$) is greater than that defined by the equation:

$$\left(\frac{A_t}{A_i}\right)_{min} = \frac{\left(1+\frac{\gamma-1}{2}M^2\right)^{1/2}\left(\gamma M^2-\frac{\gamma-1}{2}\right)^{1/\gamma-1}}{\left(\frac{\gamma+1}{2}M^2\right)^{\gamma+1/2(\gamma-1)}}$$

where

M=Mach number at launch (for M>1.0)

$\gamma$=Ratio of specific heats.

3. The projectile of claim 1 further including a driving band mounted to an outside surface of the tubular body and adapted to engage with rifling grooves in a gun barrel to impart spin to the projectile.

4. The projectile of claim 1 further including a pusher base mounted to the trailing end of the tubular body to transfer gaseous pressures in the gun barrel to a driving force on said body and being separable from the latter by virtue of stagnation pressures acting on the pusher base after launch.

5. The projectile defined in claim 3, wherein the spin imparted is in the range of 500 to 1000 rev/sec., such that spin generated stresses imposed on said projectile are slightly less than the yield strength of the material of said projectile, whereby stress induced failure of the projectile and additional drag forces thereon are reliably produced to inhibit unwanted ricochet beyond a target area.

* * * * *